US009677160B2

(12) United States Patent
Hashizume et al.

(10) Patent No.: US 9,677,160 B2
(45) Date of Patent: Jun. 13, 2017

(54) LOW C-HIGH CR 862 MPA-CLASS STEEL TUBE HAVING EXCELLENT CORROSION RESISTANCE AND A MANUFACTURING METHOD THEREOF

(75) Inventors: Shuji Hashizume, Kawasaki (JP); Yusuke Minami, Kawasaki (JP); Tomomi Taniguchi, Kawasaki (JP)

(73) Assignee: NKK Tubes, Kawasaki-shi (JP)

( * ) Notice: Subject to any disclaimer, the term of this patent is extended or adjusted under 35 U.S.C. 154(b) by 306 days.

(21) Appl. No.: 14/002,931

(22) PCT Filed: Mar. 3, 2011

(86) PCT No.: PCT/JP2011/054851

§ 371 (c)(1),
(2), (4) Date: Sep. 3, 2013

(87) PCT Pub. No.: WO2012/117546

PCT Pub. Date: Sep. 7, 2012

(65) Prior Publication Data

US 2014/0041770 A1 Feb. 13, 2014

(51) Int. Cl.

| | |
|---|---|
| ***C22C 38/18*** | (2006.01) |
| ***C22C 38/22*** | (2006.01) |
| ***C22C 38/24*** | (2006.01) |
| ***C22C 38/26*** | (2006.01) |
| ***C22C 38/40*** | (2006.01) |
| ***C22C 38/44*** | (2006.01) |
| ***C22C 38/46*** | (2006.01) |
| ***C22C 38/48*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C21D 8/10*** | (2006.01) |

(52) U.S. Cl.

CPC ..... *C22C 38/58* (2013.01); *C21D 8/105* (2013.01); *C22C 38/001* (2013.01); *C22C 38/004* (2013.01); *C22C 38/02* (2013.01); *C22C 38/04* (2013.01); *C22C 38/44* (2013.01); *C22C 38/46* (2013.01); *C22C 38/48* (2013.01); *C21D 2211/008* (2013.01)

(58) Field of Classification Search

CPC ..... C21D 8/005; C22C 38/18; C22C 38/22; C22C 38/24; C22C 38/26; C22C 38/40; C22C 38/44; C22C 38/46; C22C 38/48

USPC ..... 148/609, 325

See application file for complete search history.

(56) References Cited

U.S. PATENT DOCUMENTS

| | | | | |
|---|---|---|---|---|
| 5,496,421 | A * | 3/1996 | Hashizume | C22C 38/42 148/326 |
| 2004/0173288 | A1* | 9/2004 | Berglund | C23C 30/00 148/220 |

FOREIGN PATENT DOCUMENTS

| | | | | |
|---|---|---|---|---|
| JP | 58199850 | A | | 10/1983 |
| JP | 58199850 | A | | 11/1983 |
| JP | 60174859 | A | | 9/1985 |
| JP | 613391 | A | | 1/1986 |
| JP | 613391 | B2 | | 1/1986 |
| JP | 61207550 | A | | 9/1986 |
| JP | 6254063 | A | | 3/1987 |
| JP | 62054063 | A | | 10/1994 |
| JP | 61207550 | A | | 9/1996 |
| JP | 2002105604 | A | * | 4/2002 |
| JP | 3485034 | B2 | | 1/2004 |
| JP | 2005298840 | A | | 10/2005 |
| JP | 2009235466 | A | * | 10/2009 |
| JP | 2010242163 | A | | 10/2010 |

OTHER PUBLICATIONS

Comins, N. R., and J. B. Clark. "Recent Developments on the Role of Molybdenum in Irons and Steels." Specialty Steels and Hard Materials: Proceedings of the International Conference on Recent Developments in Specialty Steels and Hard Materials (Materials Development '82), Held in Pretoria, South Africa, Nov. 8-12, 1982. Oxford: Pergamon, 1983.*

* cited by examiner

*Primary Examiner* — Jessee Roe
*Assistant Examiner* — Anthony Liang
(74) *Attorney, Agent, or Firm* — The Webb Law Firm

(57) ABSTRACT

A purpose of the present invention is to provide a martensitic stainless steel tube exhibiting excellent performance even in severe corrosive environments in which a partial pressure of hydrogen sulfide exceeds 0.03 bar.

Provided is a low C-high Cr alloy steel tube for OCTG (Oil Country Tubular Goods) having minimum yield strength of 862 MPa and excellent corrosion resistance, wherein the steel tube contains, in percent by mass, 0.005 to 0.05% C, 12 to 16% Cr, 1.0% or less Si, 2.0% or less Mn, 3.5 to 7.5% Ni, 1.5 to 3.5% Mo, 0.01 to 0.05% V, 0.02% or less N, and 0.01 to 0.06% Ta and satisfies the relationship in the following formula (1), and the rest comprises Fe and unavoidable impurities.

$$25-25\ (\%\ Ni)+5\ (\%\ Cr)+25\ (\%\ Mo)\geq 0 \quad (1).$$

6 Claims, No Drawings

LOW C-HIGH CR 862 MPA-CLASS STEEL TUBE HAVING EXCELLENT CORROSION RESISTANCE AND A MANUFACTURING METHOD THEREOF

CROSS-REFERENCE TO RELATED APPLICATION

This application is the United States national phase of International Application No. PCT/JP2011/054851 filed Mar. 3, 2011 the disclosure of which is hereby incorporated in its entirety by reference.

TECHNICAL FIELD

The present invention relates to a low C-high Cr steel tube having minimum yield strength of 862 MPa and excellent corrosion resistance, and in particular, to a high strength martensitic stainless steel tube having minimum yield strength of 862 MPa and excellent stress corrosion cracking resistance under environments that include wet carbon dioxide and hydrogen sulfide gas in well drilling and transportation of oil and natural gas and a manufacturing method thereof.

BACKGROUND ART

In recent years, oil and natural gas produced are more likely to contain large amounts of wet carbon dioxide and hydrogen sulfide gas, and martensitic stainless steels such as 13 Cr stainless steels have been used for well drilling and transportation of oil and natural gas instead of conventional carbon steels. However, conventional martensitic stainless steels are excellent in corrosion resistance against wet carbon dioxide gas (hereinafter, refer to as "corrosion resistance"), but insufficient in stress corrosion cracking resistance against wet hydrogen sulfide (hereinafter, refer to as "stress corrosion cracking resistance"), and martensitic stainless steels with improved stress corrosion cracking resistance while maintaining excellence in strength, toughness, and corrosion resistance have been desired.

Martensitic stainless steels meeting the requirements of stress corrosion cracking resistance in addition to strength, toughness, and corrosion resistance were disclosed in Patent Documents 1 to 3.

On the one hand, martensitic stainless steels with improved stress corrosion cracking resistance under environments in which a partial pressure of hydrogen sulfide exceeds 0.01 bar were also proposed, and disclosed, for example, in Patent Documents 4 and 5.

Further, high strength martensitic stainless steels having excellent corrosion resistance was disclosed in Patent Document 6, which was already granted as a patent.

However, martensitic stainless steels disclosed in Patent Documents 1 to 3 have excellent stress corrosion cracking resistance in environments involving an extremely small amount of hydrogen sulfide, but there is a problem that martensitic stainless steels cannot be used in environments involving large amounts of hydrogen sulfide, since stress corrosion cracking occurs in environments in which a partial pressure of hydrogen sulfide exceeds 0.01 bar.

Also, martensitic stainless steels according to Patent Documents 4 and 5 cannot fully prevent stress corrosion cracking due to hydrogen sulfide.

Further, in any one of the abovementioned martensitic stainless steels, there are problems that from the viewpoint of strength, attempts to strengthen the steel result in significant deterioration of toughness and stress corrosion cracking resistance, whereby there is no other choice but to sacrifice either one of strength or toughness and stress corrosion cracking resistance. Therefore, there is a drawback that the martensitic stainless steel cannot be applied, for example, to deep oil and gas wells where high strength, excellent stress corrosion cracking resistance, excellent corrosion resistance, and good toughness are simultaneously required.

To solve the problems in conventional technology, Patent Document 6 disclosed a low C-high Cr stainless steel tube having minimum yield strength of 862 MPa which can be used in environments involving large amounts of hydrogen sulfide without causing stress corrosion cracking while maintaining excellent corrosion resistance by simultaneously improving strength, stress corrosion cracking resistance, and toughness of conventional martensitic stainless steels, and a manufacturing method thereof.

PATENT DOCUMENT

Patent Document 1: Japanese Patent Application Publication (JP-B) No. 61-3391.

Patent Document 2: Japanese Patent Application Laid-Open (JP-A) No. 58-199850.

Patent Document 3: Japanese Patent Application Laid-Open (JP-A) No. 61-207550.

Patent Document 4: Japanese Patent Application Laid-Open (JP-A) No. 60-174859.

Patent Document 5: Japanese Patent Application Laid-Open (JP-A) No. 62-54063.

Patent Document 6: Japanese Patent Publication No. 3485034.

DISCLOSURE OF INVENTION

Problems to be Solved by the Invention

However, environments to which steel tubes, in particular, OCTG (Oil Country Tubular Goods) are exposed become more and more severer, and it is found that even high strength martensitic steel tubes having excellent corrosion resistance developed in Patent Document 6 do not have sufficient stress corrosion cracking resistance in severer environments in which a partial pressure of hydrogen sulfide exceeds 0.03 bar. Then, a purpose of the present invention is to provide a steel tube which exhibits excellent performance even in very severe corrosive environments in which a partial pressure of hydrogen sulfide exceeds 0.03 bar.

Target properties herein are selected as follows in view of the properties required for a steel tube for drilling and transportation of oil and natural gas containing carbon dioxide gas and hydrogen sulfide. Major application of a steel tube is for OCTG, but its application may include steel tubes for line pipe in transportation of oil and natural gas in which similar performance is required.

Strength: 0.2% offset yield strength between 862 MPa and 965 MPa.

Toughness: The absorbed energy value in the Charpy impact test with a full size specimen at −20° C. (referred to as "Charpy impact value") is 100 J or more.

Corrosion resistance: The corrosion rate is 0.5 mm/year or less in environments under which test pieces are immersed in a 20% aqueous solution of NaCl at 180° C. under carbon dioxide at 10 bar.

Stress corrosion cracking resistance: When 90% of the 0.2% offset yield strength is applied to test pieces in a 20% aqueous solution of NaCl at pH 4.5 saturated with hydrogen sulfide gas at 0.03 bar, the test pieces sustain for 720 hours or more without failure.

SUMMARY OF INVENTION

Means for Solving Problems

To achieve the target performance, the present invention uses a means indicated as follows.

(1) The present invention relates to a low C-high Cr steel tube having minimum yield strength of 862 MPa and excellent corrosion resistance, wherein the steel tube contains, in percent by mass, 0.005 to 0.05% C, 12 to 16% Cr, 1.0% or less Si, 2.0% or less Mn, 3.5 to 7.5% Ni, 1.5 to 3.5% Mo, 0.01 to 0.05% V, 0.02% or less N, and 0.01 to 0.06% Ta and satisfies the relationship in the following formula (1), and the balance comprises Fe and unavoidable impurities. The steel tube has the feature that as the alloy steel in addition to V which is a strong carbide forming element, Ta having the similar function is contained as an essential component.

$$25\text{-}25\ (\%\ \mathrm{Ni})+5\ (\%\ \mathrm{Cr})+25\ (\%\ \mathrm{Mo})\geq 0 \quad (1)$$

(2) The present invention relates to a low C-high Cr steel tube having minimum yield strength of 862 MPa and excellent corrosion resistance according to (1), wherein the steel tube further contains 0.1% or less Nb in percent by mass.

(3) A manufacturing method of the present invention is a method in which carbides are uniformly precipitated in grains while preventing the carbides from preferential precipitation in grain boundaries by the steps that after hot working of an alloy steel having the composition according to (1) or (2), the alloy steel is austenitized at the temperature between the Ac3 transformation point and 980° C., then cooled to the temperature of 100° C. or less followed by tempering at the temperature between 500° C. and 700° C.

Effects of the Invention

According to the present invention, by specifying the alloy composition and the manufacturing conditions, it can provide a low C-high Cr steel tube having minimum yield strength of 862 MPa, which is excellent in toughness, and in which not only corrosion resistance against carbon dioxide gas but also stress corrosion cracking resistance in environments of a concentrated aqueous solution of NaCl involving hydrogen sulfide at high pressure is excellent.

PREFERRED EMBODIMENTS FOR CARRYING OUT THE INVENTION

The present inventors conducted an extensive study for solving the above problems, and as the results, obtained the findings as follows.

Increase of the chromium content is effective for improving corrosion resistance of a martensitic stainless steel. However, increase of the chromium content, on one hand, promotes formation of δ-ferrite phase, thereby deteriorating strength and toughness. Then, a method of preventing formation of δ-ferrite phase includes a method of increasing the content of nickel which is an austenite forming element, but increase of the nickel content has constraints in setting the tempering temperature. Increase of the carbon content is also effective for preventing formation of δ-ferrite phase, but carbides are precipitated during tempering, rather resulting in deterioration of corrosion resistance and stress corrosion cracking resistance so that the content thereof has to be rather limited.

Generally, strengthening of steels deteriorates toughness and stress corrosion cracking resistance. The present inventors found synergistic effects that a martensitic stainless steel in which with containing an appropriate amount of V, an appropriate amount of Ta is simultaneously contained as an essential component makes easier fine dispersing carbides precipitated in a matrix of stainless steel after heat treatment thereby strengthening a stainless steel easier, rather than independent addition of each metal, and obtained new findings that strengthening can be achieved without deteriorating toughness, and stress corrosion cracking resistance in environments with hydrogen sulfide at high pressure can also be improved. Further, the effects become more significant by addition of Nb.

Based on the above findings and after the above constraints on the metal microstructure are taken into an account, the present inventors found a new martensitic stainless steel with excellent toughness, high strength, and excellent stress corrosion cracking resistance at the level which conventional martensitic stainless steels could not reach, by containing certain amounts of V and Ta, or V, Ta, and Nb, adjusting the heat treatment condition to a specific range in order to consistently obtain minimum yield strength of 862 MPa, and uniformly dispersing carbides are precipitated in grains, and the present inventors also found a manufacturing method thereof to complete the present invention.

That is, the present invention can provide a low C-high Cr steel tube having minimum yield strength of 862 MPa, of which stress corrosion cracking resistance and toughness of conventional high strength martensitic stainless steels are improved by specifying the alloy composition and the manufacturing conditions in the following range, allowing for its use even in environments involving large amounts of hydrogen sulfide without stress corrosion cracking while maintaining corrosion resistance.

Hereinafter, why alloy elements are added in the present invention, why the amount thereof is specified, and why manufacturing conditions are specified will be described. The content of each alloy element in steel is in percent by mass.

(1) Range of Composition

C: 0.005 to 0.05%

Carbon is a strong austenite forming element as well as an element essential for generating strength of stainless steel. However, C binds with Cr during tempering to be precipitated as carbides, which cause deterioration of corrosion resistance, stress corrosion cracking resistance, and toughness. When the content of C is below 0.005%, adequate strength cannot be obtained, whereas when exceeding 0.05%, deterioration of corrosion resistance, stress corrosion cracking resistance, and toughness becomes significant so that the content of C is set between 0.005 and 0.05%, preferably between 0.02 and 0.04%.

Cr: 12 to 16%

Chromium is a fundamental element constituting martensitic stainless steels and further an important element imparting corrosion resistance, but when the content is below 12%, adequate corrosion resistance cannot be obtained, whereas exceeding 16%, the amount of δ-ferrite formed is increased regardless of any adjustment of other elements, thereby deteriorating strength and toughness so that the content of Cr is set between 12 and 16%, preferably between 12 and 13%.

Si: 1.0% or less

Silicon is an element required as a deoxidizer but a strong ferrite forming element, and when the content exceeds 1.0%, formation of δ-ferrite phase is promoted so that the upper limit is set at 1.0%, preferably at 0.5%, more preferably at 0.3%.

Mn: 2.0% or less

Manganese is effective as a deoxidizer and a desulfurization agent as well as an austenite forming element for preventing appearance of δ-ferrite phase. However, Mn has detrimental effects on corrosion resistance so that the upper limit is set at 2.0%, preferably at 0.5%, more preferably at 0.3%.

Ni: 3.5 to 7.5%

Nickel improves corrosion resistance as well as being an element very effective for formation of austenite, but when the content is below 3.5%, its effects are small, whereas when the content of Ni is increased, the transformation point (Ac 1 transformation point) is lowered to narrow a temperature range of tempering so that the content of Ni is set between 3.5% and 7.5%, preferably between 5.0% and 7.0%.

Mo: 1.5% to 3.5%

Molybdenum is an element particularly effective for stress corrosion cracking resistance and corrosion resistance, but when the content is below 1.5%, its effects are not observed, whereas when exceeding 3.5%, δ-ferrite phase is formed excessively so that the content of Mo is set between 1.5% and 3.5%, preferably between 2.0% and 3.3%.

V: 0.01 to 0.05%

Vanadium is a strong carbide forming element, and uniformly precipitates fine carbides in grains promoting grain refinement of the carbides by preventing preferential precipitation in grain boundaries, and improves stress corrosion cracking resistance as well as contributes to increase strength. However, it is also a ferrite forming element to increase formation of δ-ferrite phase. When the content is below 0.01%, effects for improving stress corrosion cracking resistance are not observed, whereas when exceeding 0.05%, the saturated effects of improving stress corrosion cracking resistance is observed and the amount of δ-ferrite phase is increased so that the content of V is set between 0.01 and 0.05%, preferably between 0.02 and 0.04%.

N: 0.02% or less

Nitrogen is a detrimental element for improving corrosion resistance, but also an austenite forming element. When the content exceeds 0.02%, it forms nitrides during tempering to precipitate causing deterioration of corrosion resistance, stress corrosion cracking resistance, and toughness so that the upper limit is set at 0.02%, preferably at 0.015%.

Ta: 0.01 to 0.06%

Tantalum is a strong carbide forming element, and uniformly precipitates fine carbides in grains to improve stress corrosion cracking resistance as well as contributes to improve strength. When the content is below 0.01%, improved effects on stress corrosion cracking resistance are not observed, whereas when exceeding 0.06%, the saturated effects of improving stress corrosion cracking resistance is observed so that the content of Ta is set between 0.01 and 0.06%, preferably between 0.02 and 0.05%.

$$\text{A value: } 25\text{-}25\ (\%\ \text{Ni})+5\ (\%\ \text{Cr})+25\ (\%\ \text{Mo})\geq 0 \quad (1)$$

The A value is a calculated value using the formula (1) for providing the relationship between the Ac1 transformation point and the amount of major elements (Ni, Cr, and Mo) added. When the Ac1 transformation point is lowered, it becomes difficult to obtain a well-tempered martensite structure, then resulting in deterioration of stress corrosion cracking resistance. Therefore, the A value in composition of the stainless steel has to be zero or more.

In the present invention Nb may be contained in addition to the fundamental components above.

Nb: 0.1% or less

Niobium is a strong carbide forming element and promotes grain refinement of carbides by uniformly precipitating fine carbides in grains to improve stress corrosion cracking resistance. However, Nb is also a ferrite forming element to increase formation of δ-ferrite phase. When the content exceeds 0.1%, the saturated effects of improving stress corrosion cracking resistance is observed and δ-ferrite phase formed is increased so that the content of Nb is set at 0.1% or less, preferably at 0.05% or less.

Also, when among unavoidable impurities represented by P, S, and O, the contents of P and S are set at 0.04% or less and at 0.01% or less, respectively, stress corrosion cracking resistance targeted in the present invention can be assured, and such steels do not have any problem in manufacture of seamless steel tubes and electric resistance-welded steel pipes of which hot rolled steel plates are used as a raw material. However, any one of these impurities is an element to deteriorate hot workability and stress corrosion cracking resistance of steels so that the less the impurities, the better. The amount of O and other unavoidable impurities are preferably as little as possible.

A steel tube (martensitic stainless steel) having minimum yield strength of 862 MPa, which can be used without stress corrosion cracking even in environments involving large amounts of hydrogen sulfide while maintaining corrosion resistance can be obtained by adjusting steel composition to the above range to improve stress corrosion cracking resistance of a conventional high strength martensitic stainless steel.

Steels with such properties can be manufactured by a manufacturing method as follows.

(2) Manufacturing Process of Steel Tubes

A steel of which the composition is adjusted to the above range is melted in a converter or an electric arc furnace and then converted to billets by an ordinary ingot-making method or a continuous casting method. Billets are subjected to hot working to manufacture seamless steel tubes or slabs are subjected to hot rolling to produce steel sheets followed by forming into steel pipes, which are heated to the temperature between the Ac3 transformation point and 980° C. for austenitizing and then quenched to 100° C. or less for cooling, followed by tempering at the temperature between 500° C. and 700° C.

a. Heating temperature: between Ac3 transformation point and 980° C.

When the heating temperature is below the Ac3 transformation point, austenitization of steels does not occur and effects of quench hardening are not obtained so that the lower limit of heating temperature is set at the Ac3 transformation point. On the other hand, when the heating temperature exceeds 980° C., not only the grain coarsening occurs to lead to insufficient strength but also toughness is deteriorated so that the upper limit of temperature is set at 980° C.

b. Tempering temperature: between 500° C. and 700° C.

As described above, tempering treatment is essential for uniformly dispersing and precipitating fine carbides of V and Ta to strengthen steels without deteriorating stress corrosion cracking resistance. The tempering temperature is set between 500° C. and 700° C., and when the temperature exceeds 700° C., a 0.2% offset yield strength of 852 MPa or higher cannot be obtained so that the upper limit is set at 700° C. When the tempering temperature is below 500° C., enough amounts of carbide are not precipitated and the target value of 0.2% offset yield strength and stress corrosion cracking resistance cannot be obtained so that the lower limit is set at 500° C.

EXAMPLES

Hereinafter, specific examples of the present invention will be described. The present inventors melted, as the steel for testing, invented steels N1-N7 and comparative steels C1-C4 with chemical composition indicated in Table 1 and cast into ingots, which were hot-rolled to a steel sheet with thickness of 12 mm, followed by heat treatment to determine, under the following conditions, the mechanical properties (strength and toughness), corrosion resistance, and stress corrosion cracking resistance. Comparative steels C1 and C2 are the steel not containing Ta and invented in Patent Document 6. Also, comparative steel C3 is the steel not containing V and comparative steel C4 is the steel in which the content of Ta exceeds the upper limit.

Strength: 0.2% offset yield strength at ambient temperature

Toughness: Charpy impact value in the Charpy impact test with full size specimen at −20° C.

Corrosion resistance: The corrosion rate in a 20% aqueous solution of NaCl in environments of 180° C. and 10 bar of carbon dioxide for two weeks.

Stress corrosion cracking resistance (sulfide stress cracking (SSC) resistance: When 90% of the 0.2% offset yield strength was applied to test pieces in a 20% aqueous solution of NaCl at pH 4.5 saturated with hydrogen sulfide at 0.03 bar, inspection of the test pieces for the presence or absence of failure after 720 hours.

Table 2 indicates the Ac1 and Ac3 transformation temperatures, heating temperature, and tempering temperature of steels for testing. Also Table 3 indicates the test results of the mechanical properties, corrosion resistance, and stress corrosion cracking resistance.

TABLE 1

Table 1 Chemical composition (mass percent) of steels for testing

| Steel | C | Si | Mn | P | S | Ni | Cr | Mo | N | V | Nb | Ta | A value*[1] | Reference |
|---|---|---|---|---|---|---|---|---|---|---|---|---|---|---|
| N1 | 0.031 | 0.190 | 0.22 | 0.012 | 0.001 | 5.52 | 12.69 | 2.24 | 0.014 | 0.034 | 0.010 | 0.024 | 6 | Invented steel |
| N2 | 0.028 | 0.190 | 0.24 | 0.012 | 0.001 | 5.49 | 12.52 | 2.24 | 0.014 | 0.032 | 0.020 | 0.046 | 7 | Invented steel |
| N3 | 0.027 | 0.190 | 0.22 | 0.009 | 0.001 | 6.53 | 12.65 | 3.20 | 0.013 | 0.034 | 0.000 | 0.023 | 5 | Invented steel |
| N4 | 0.027 | 0.190 | 0.22 | 0.010 | 0.001 | 6.54 | 12.60 | 3.20 | 0.013 | 0.034 | 0.010 | 0.022 | 5 | Invented steel |
| N5 | 0.027 | 0.190 | 0.22 | 0.010 | 0.001 | 6.50 | 12.56 | 3.18 | 0.013 | 0.033 | 0.020 | 0.021 | 5 | Invented steel |
| N6 | 0.028 | 0.190 | 0.22 | 0.09 | 0.001 | 6.46 | 12.51 | 3.17 | 0.014 | 0.034 | 0.000 | 0.038 | 5 | Invented steel |
| N7 | 0.029 | 0.200 | 0.22 | 0.09 | 0.001 | 6.45 | 12.46 | 3.16 | 0.014 | 0.034 | 0.020 | 0.036 | 5 | Invented steel |
| C1 | 0.030 | 0.200 | 0.22 | 0.010 | 0.001 | 5.53 | 12.55 | 2.30 | 0.014 | 0.033 | 0.000 | 0.000 | 7 | Comparative steel |
| C2 | 0.030 | 0.200 | 0.22 | 0.010 | 0.001 | 6.48 | 12.57 | 3.20 | 0.014 | 0.033 | 0.000 | 0.000 | 6 | Comparative steel |
| C3 | 0.030 | 0.200 | 0.22 | 0.010 | 0.001 | 6.34 | 12.53 | 1.78 | 0.014 | 0.000 | 0.000 | 0.025 | −1 | Comparative steel |
| C4 | 0.029 | 0.190 | 0.25 | 0.011 | 0.001 | 5.54 | 12.65 | 2.29 | 0.014 | 0.034 | 0.001 | 0.083 | 6 | Comparative steel |

*[1]A value = 25 − 25*Ni + 5*Cr + 25*Mo

TABLE 2

Table 2 Transformation temperature and heat treatment conditions of steels for testing

| | Transformation temperature | | Heat treatment conditions | | |
|---|---|---|---|---|---|
| | ° C. | | ° C. | | |
| Steel | Ac3 | Ac1 | Quenching | Tempering | Reference |
| N1 | 750 | 692 | 920 | 625 | Invented steel |
| N2 | 749 | 691 | 930 | 620 | Invented steel |
| N3 | 730 | 680 | 920 | 600 | Invented steel |
| N4 | 736 | 680 | 910 | 610 | Invented steel |
| N5A | 754 | 683 | 920 | 600 | Invented steel |
| N5B | 754 | 683 | 920 | 625 | Invented steel |
| N6 | 741 | 682 | 930 | 600 | Invented steel |
| N7 | 765 | 690 | 900 | 620 | Invented steel |
| C1 | 760 | 694 | 920 | 600 | Comparative steel |
| C2 | 745 | 685 | 920 | 600 | Comparative steel |
| C3 | 803 | 670 | 910 | 580 | Comparative steel |
| C4 | 760 | 690 | 920 | 565 | Comparative steel |

TABLE 3

Table 3 Test results

| Steel | 0.2% offset yield strength MPa | Charpy impact value at −20° C. J | Corrosion resistance (corrosion rate) mm/year | Stress corrosion cracking test (720 hours) | Overall assessment | Reference |
|---|---|---|---|---|---|---|
| N1 | 889 | 230 | 0.30 | No failure | Good | Invented steel |
| N2 | 900 | 220 | 0.29 | No failure | Good | Invented steel |
| N3 | 934 | 220 | 0.09 | No failure | Good | Invented steel |
| N4 | 937 | 225 | 0.10 | No failure | Good | Invented steel |
| N5A | 952 | 227 | 0.11 | No failure | Good | Invented steel |
| N5B | 893 | 228 | 0.11 | No failure | Good | Invented steel |
| N6 | 956 | 224 | 0.11 | No failure | Good | Invented steel |
| N7 | 929 | 220 | 0.09 | No failure | Good | Invented steel |
| C1 | 899 | 230 | 0.26 | Failure | No good | Comparative steel |
| C2 | 925 | 225 | 0.10 | Failure | No good | Comparative steel |
| C3 | 851 | 227 | 0.10 | Failure | No good | Comparative steel |
| C4 | 969 | 227 | 0.27 | Failure | No good | Comparative steel |

N1, N2, N3, N4, N5A, N5B, N6, and N7 of the steels in the present invention meet the target range of the 0.2% offset yield strength and the Charpy impact value. They also pass the tests on corrosion resistance and stress corrosion cracking resistance.

On the one hand, among comparative steels, C1 and C2 are the steels not containing Ta, C3 is the steel not containing V, and C4 is the steel of which the content of Ta exceeds the upper limit That is, since one of components in the steel is not in a specified range of the present invention, the 0.2% offset yield strength and stress corrosion cracking resistance do not meet the target properties as shown in the test results. Particularly, C1 and C2 are the invented steel not containing Ta in Patent Document 6, and it is confirmed that C1 and C2 have good SSC resistance in a 5% aqueous solution of NaCl saturated with hydrogen sulfide gas at 0.01 bar, but in a concentrated solution (20%) of NaCl at pH 4.5 saturated with hydrogen sulfide gas at higher pressure (0.03 bar), the test pieces are failed. It can be found that containment of Ta can significantly improve stress corrosion cracking resistance under severer environments. Similarly, C3 cannot obtain minimum yield strength of 862 MPa even though tempering is performed at the temperature below 600° C. and test pieces were fractured in stress corrosion cracking tests. Above results indicate addition of multiple metals of V and Ta improves the physical properties which were not obtained by addition of a single metal, indicating synergistic effects of addition of multiple metals.

INDUSTRIAL APPLICABILITY

A low C-high Cr steel tube having minimum yield strength of 862 MPa and excellent corrosion resistance exhibits not only excellent resistance against corrosion by carbon dioxide gas but also excellent performance in very severe corrosive environments in which a partial pressure of hydrogen sulfide exceeds 0.03 bar, then enabling to apply for steel tubes in well drilling for and transportation of oil and natural gas containing carbon dioxide gas and hydrogen sulfide.

The invention claimed is:

1. A low C-high Cr high strength martensitic stainless steel tube for oil and natural gas wells having a yield strength of 862 to 965 MPa, wherein said steel tube consists of, in percent by mass, 0.027 to 0.05% C, 12 to 16% Cr, 1.0% or less Si, 2.0% or less Mn, 5.0 to 7.5% Ni, 1.5 to 3.5% Mo, 0.01 to 0.05% V, 0.02% or less N, 0.01 to 0.06% Ta, and optionally 0.1% or less Nb, the remainder being Fe and unavoidable impurities and satisfies the following formula (1)

$$25\text{-}25\ (\%\ Ni)-5\ (\%\ Cr)+25\ (\%\ Mo)\geq 0 \quad (1).$$

2. The low C-high Cr high strength martensitic stainless steel tube for oil and natural gas wells having yield strength of 862 to 965 MPa according to claim 1, wherein said steel tube contains 0.1% or less Nb in percent by mass.

3. A manufacturing method of a low C-high Cr high strength martensitic stainless steel tube for oil and natural gas wells having a yield strength of 862 to 965 MPa, wherein after hot working of a low C-high Cr steel, the low C-high Cr steel is austenitized at a temperature between the Ac3 transformation point and 980° C., then cooled to a temperature of 100° C. or less followed by tempering at a temperature between 500° C. and 700° C., wherein the low C-high Cr steel consists of, in percent by mass, 0.027 to 0.05% C, 12 to 16% Cr, 1.0% or less Si, 2.0% or less Mn, 3.5 to 7.5% Ni, 1.5 to 3.5% Mo, 0.01 to 0.05% V, 0.02% or less N, and 0.01 to 0.06% Ta, the remainder being Fe and unavoidable impurities and satisfies the following formula (1)

$$25\text{-}25\ (\%\ Ni)+5\ (\%\ Cr)+25\ (\%\ Mo)\geq 0 \quad (1).$$

4. A manufacturing method of a low C-high Cr high strength martensitic stainless steel tube for oil and natural gas wells having a yield strength of 862 to 965 MPa, wherein after hot working of a low C-high Cr steel, the low C-high Cr steel is austenitized at a temperature between the Ac3 transformation point and 980° C., then cooled to a temperature of 100° C. or less followed by tempering at a temperature between 500° C. and 700° C., wherein the low C-high Cr steel consists of, in percent by mass, 0.027 to 0.05% C, 12 to 16% Cr, 1.0% or less Si, 2.0% or less Mn, 3.5 to 7.5% Ni, 1.5 to 3.5% Mo, 0.01 to 0.05% V, 0.02% or less N, 0.01 to 0.06% Ta, and 0.1% or less Nb, the remainder being Fe and unavoidable impurities and satisfies the following formula (1)

$$25-25\ (\%\ Ni)+5\ (\%\ Cr)+25\ (\%\ Mo)\geq 0 \qquad (1).$$

5. The manufacturing method according to claim 3, wherein the Ni is 5.0-7.5%.

6. The manufacturing method according to claim 4, wherein the Ni is 5.0-7.5%.

* * * * *